US006840306B2

(12) United States Patent
Mota et al.

(10) Patent No.: US 6,840,306 B2
(45) Date of Patent: Jan. 11, 2005

(54) MULTI-TUBE HEAT EXCHANGERS, AND A METHOD OF MANUFACTURING SUCH HEAT EXCHANGERS

(75) Inventors: Gérard Mota, Marseilles (FR); Jean-Claude Ebren, Marseilles (FR); Michel Cremieux, Marseilles (FR)

(73) Assignee: MOTA, Aubagne (FR)

( * ) Notice: Subject to any disclaimer, the term of this patent is extended or adjusted under 35 U.S.C. 154(b) by 0 days.

(21) Appl. No.: 10/361,644

(22) Filed: Feb. 11, 2003

(65) Prior Publication Data

US 2003/0234099 A1 Dec. 25, 2003

(30) Foreign Application Priority Data

Jun. 21, 2002 (FR) ..... 02 07708

(51) Int. Cl.[7] ..... F28D 7/10
(52) U.S. Cl. ..... 165/76; 165/158; 165/159
(58) Field of Search ..... 165/76, 158–162

(56) References Cited

U.S. PATENT DOCUMENTS 1,955,006 A * 4/1934 Mateer et al. ..... 165/76
2,956,704 A * 10/1960 Boni, Jr. ..... 220/328
3,079,992 A * 3/1963 Otten et al. ..... 165/76
3,223,154 A * 12/1965 Goebel ..... 165/158
3,863,713 A * 2/1975 Tramontini ..... 165/158
3,915,337 A * 10/1975 Parsels ..... 220/327
3,948,315 A * 4/1976 Powell ..... 165/70
4,421,160 A * 12/1983 Stafford et al. ..... 165/76
4,589,478 A * 5/1986 Wunder ..... 165/76

FOREIGN PATENT DOCUMENTS

EP 1146310 10/2001
FR 623803 7/1927

* cited by examiner

*Primary Examiner*—Allen Flanigan
(74) *Attorney, Agent, or Firm*—Dennison, Schultz, Dougherty & MacDonald

(57) ABSTRACT

The present invention relates to a heat exchanger (1) comprising a multi-tube bundle and a shell (2), the shell and the bundle being mutually engaged by means of an abutment inside the cavity defined by the shell, the abutment preventing or restricting movement of the bundle relative to the shell. The invention also provides a method of manufacturing such a heat exchanger (1).

16 Claims, 6 Drawing Sheets

MULTI-TUBE HEAT EXCHANGERS, AND A METHOD OF MANUFACTURING SUCH HEAT EXCHANGERS

The present invention relates to heat exchangers comprising multiple tubes in a shell, and to methods of manufacturing such heat exchangers.

BACKGROUND OF THE INVENTION

The invention applies particularly to heat exchangers for exchanging heat between a first fluid flowing in a plurality of tubes forming a multi-tube bundle, and a second fluid flowing around the tubes in a cylindrical cavity defined by a hollow body (or shell) in which the bundle of tubes extends; the invention applies in particular to heat exchangers for engines, gear boxes, reversing means, compressors, hydraulic units, . . . In this type of heat exchanger, heat energy is transferred between the hot source and the cold sink in particular by conduction through the walls of the tubes. In order to obtain sufficient heat transfer flow (and/or heat exchange coefficient), the tubes are made of a material having high thermal conductivity, such as a metal alloy based on copper, aluminum, nickel, titanium, or stainless steels.

The invention applies in particular to such heat exchangers having two tube plates pierced by a plurality of orifices. Each one of the two ends of each tube is engaged in a corresponding orifice in one of the tube plates, and is secured to said plate in leaktight manner in particular by brazing, welding, or tube-expanding.

In addition to the tubes and the tube plates at its ends, the bundle of tubes may also include baffles for guiding the flow of the second fluid inside the hollow body. In general, such baffles are essentially constituted by thin plates extending transversely relative to the tubes and parallel to the end tube plates, they are regularly spaced apart along the tubes, and they serve to close off a fraction (generally a circular fraction) of the cross-section of the hollow body in order to guide the second fluid. The bundle may also have fins crimped or otherwise connected to the outside surfaces of the tubes of the bundles. It may also have other secondary surfaces.

As a general rule, such heat exchangers also include, at each of their two longitudinal ends, a cap (end tank) covering a respective one of said tube plates, and serving either to connect the heat exchanger to two ducts external to the heat exchanger for transporting the first fluid, or else for guiding said fluid if the cap is a "blind" cap, i.e. having no connection to an external duct.

The hollow body has an inlet orifice for admitting the second fluid into said cavity and also an outlet orifice for said fluid. The hollow body is generally constituted by a part of generally tubular shape provided at each of its two longitudinal ends with a respective annular flange. Each flange is pierced by a plurality of orifices extending along the longitudinal axis of the heat exchanger and receiving screws or similar fasteners enabling the body to be secured in leaktight manner to at least one of the tube plates and also to the two caps.

The bodies of small heat exchangers, and in particular heat exchangers having a maximum dimension of less than 0.25 meters (m)) are generally made by casting a metal alloy without applying pressure, the body and the flanges being cast as a single piece. That technique presents drawbacks: the inside face of the body needs to be machined over its entire length in order to present roughness and geometrical quality that are compatible with the use to which it is put; the outside faces of the flanges also need to be smoothed; such molded pieces frequently present defects in their material leading to porosity that is incompatible with their function as acting as a leakproof wall; worse, these defects can be inspected validly only after mechanical machining (boring, turning, . . . ); this leads to expensive pieces being rejected; the technique of casting without applying pressure (casting into sand molds) also makes it impossible to obtain walls that are thin.

French patent No. 623 803 proposes a multi-tube heat exchanger in which the body is constituted by a segment of ordinary pipe but does not have any end flanges. That technique makes it difficult and/or expensive to provide said cavity with leaktight inlet and outlet couplings for the second fluid.

Document EP-A-1 146 310 describes a heat exchanger whose extruded shell presents an external spline having the inlet and outlet orifices for the second fluid formed therein, thereby overcoming that problem. That heat exchanger does not have means for enabling the hollow body to be rigidly connected to the bundle of tubes, with mechanical connection between those two elements resulting essentially from contact (pressure) forces acting between said two pieces via sealing members such as O-rings, which sealing members are flattened (compressed) between pairs of cylindrical bearing faces respectively provided on each of two pieces. In the absence of the sealing members, the bundle would be free to slide inside the cavity of the body. In the presence of the sealing members, the bundle can still slide inside the cavity under drive from sufficient force, in particular under drive due to the tubes of the bundle lengthening because of thermal expansion. Each sealing member is received in an annular groove provided in the outside face of the corresponding tube plate. This makes it possible to avoid forming grooves in the inside face of the wall of the hollow body so that the wall then requires no more than a chamfer to be formed at the or each of its inside ends. That makes it possible to slide in a bundle whose tube plate is provided with the sealing gasket without damaging the gasket, and this also makes it easier to flatten the gasket.

OBJECTS AND SUMMARY OF THE INVENTION

An object of the invention is to provide such a heat exchanger which is improved, together with a method of manufacturing such heat exchangers in a manner that enables the cost thereof to be reduced.

In a first aspect the invention consists in providing such a heat exchanger in which mutual engagement between the shell and the bundle forms an abutment inside the cavity defined by the shell, which abutment prevents or restricts movement of the bundle relative to the shell. Generally, this mutual engagement results, at least in part, either from at least a piece of the tube bundle being enlarged, or from the cavity defined by the shell being narrowed, or from a combination of both, thereby forming a positioning abutment for the multi-tube bundle.

This mutual engagement may be the result of a piece of the bundle and/or a piece of the shell being deformed, or it may be the result of inserting an abutment-forming member (or shoulder) inside the cylindrical cavity defined by the shell. In both cases, such deformation and/or insertion is performed after the bundle has been inserted and positioned correctly inside the shell.

This makes it possible to prevent or restrict any movement in rotation and/or translation of the tubular bundle inside the shell. Consequently, this makes it possible to use baffles that do not present central symmetry as do the disk-shaped baffles described in document EP 1 146 310. This makes it possible in particular to use baffles that are each in the form of a portion of a disk, i.e. a cut disk, together with a multi-tube bundle having one or more tubes extending along or in the immediate vicinity of the central longitudinal axis of the bundle. Consequently, the distribution and/or the number of tubes in the bundle can be improved (increased) for a cavity of given volume, thereby also increasing the efficiency and/or the compactness of the heat exchanger.

The abutment is preferably made at least in part in the form of a projection provided on the inside face of the wall of the shell, so there is no need to make a piece that is separate from the shell for this purpose.

More preferably, this abutment-forming narrowing or projection extends over a fraction only of the inside transverse circular outline of the shell. Making this abutment is further simplified by making it around one of the fluid inlet and outlet orifices leading to and from the cavity defined in the shell, in particular by chasing at least a portion of a collar towards the inside of the cavity. In addition or alternatively, the projection may be made at the periphery of a thin wall of the bundle, in particular of a tongue secured to a tube plate of the bundle, by chasing said thin wall or tongue towards the outside of the cavity so as to obtain either a rigid friction connection between the bundle and the shell, or so as to obtain blocking between them by the wall or the tongue penetrating into an orifice formed in the wall of the shell, in particular in one of said fluid inlet or outlet orifices.

In another possible embodiment, the projection may be incorporated at the end of a piece for connecting the shell to a duct for transporting said fluid, referred to above as the second fluid. For example, the projection may consist in a tubular portion extending a coupling screwed into a tapped hole provided in the wall of the shell. This can make it possible to obtain a rigid connection between the bundle and the shell, which connection is reversible (i.e. it can be disassembled).

In a preferred embodiment, the projection is constituted essentially by a portion of the wall of the shell and is provided (and/or extends) around at least one of said (fluid inlet and outlet) orifices. The projecting abutment is preferably suitable for engaging in a setback or notch provided at the periphery of a piece of the tube bundle, preferably at the periphery of a portion of a tube plate.

Under such circumstances, said piece which comprises both a first portion in the form of a disk pierced by holes for passing and securing tubes of the bundle, and a second portion in the form of a circular tube or flange extending longitudinally from the inside face of the disk-shaped first portion, preferably includes a notch or setback of substantially circular profile and of a diameter matching the dimensions of the abutment projecting from the inside face of the shell, said notch or setback being integrated in the second portion of the tube plate.

When two such projecting abutments forming integral portions of the shell are provided, one around each of the two through orifices for the second fluid, then the abutments co-operate respectively with two corresponding notches provided in the two tube plates, and the bundle can then no longer be extracted from the cavity, the connection generally being not reversible.

Such integral projecting abutments are preferably made by deforming a collar provided on the wall of the shell at the inside end of a duct provided in said wall for passing the second fluid. This method of manufacture is particularly simple and inexpensive. As a general rule, such deformation needs to be performed after the tube bundle has been put into its final location inside the cavity defined by the shell.

Thus, in another aspect, the method provides a method of manufacturing a heat exchanger comprising a multi-tube bundle and a shell, in which method the shell and the bundle are engaged mutually in such a manner as to form an abutment inside the cavity defined by the shell, said abutment restricting or preventing movement of the bundle inside the shell. In a particular implementation of the method of the invention, in order to make a multi-tube heat exchanger having a shell that is extruded and a multi-tube bundle having two tube plates fitted with respective setbacks or notches in their peripheries, the following operations are performed in succession:

- piercing the wall of the shell to form a fluid inlet orifice and a fluid outlet orifice in order to provide two fluid flow ducts through said wall, each duct presenting a respective narrowed opening beside the inside face of the shell, which narrowed opening results from an annular collar obtained while piercing the wall by means of a shaped drill bit (i.e. having a shoulder);
- tapping each flow duct over a portion excluding the collar so as to enable a coupling to be screwed into each tapped orifice;
- engaging the bundle in the shell and positioning the notches or setbacks in line respectively with each flow duct pierced through the shell; and
- while preventing the bundle from moving inside the shell, deforming each collar by acting thereon by means of a tool that preferably has a spherical bearing surface so as to apply sufficient (radial) force to cause at least a portion of each collar projecting from the inside face of the wall of the shell to be engaged in the corresponding notch or setback so that the bundle is prevented from moving inside the shell.

In another aspect, the invention provides a heat exchanger comprising a multi-tube bundle and a tubular shell that does not have any end flange, the bundle having two tube plates, with at least one of the plates (and preferably both plates) comprising: i) a first portion generally in the form of a disk that is pierced with orifices for receiving the tubes of the bundle; where appropriate, ii) a second portion extending from the inside face of the first portion and incorporating either a housing for receiving an abutment projecting from the inside face of the shell or an expandable wall or tongue provided to engage, on being deformed, in an orifice formed in the wall of the shell; and iii) a third portion of tubular shape extending from the outside face of the first portion and designed to be engaged in one end of a duct for carrying the first fluid, which duct is fixed to the third portion of the plate by forced engagement and/or by clamping. For this purpose, the tubular third portion preferably includes an external annular rib.

This makes it possible in particular to reduce the number of sealing gaskets that are needed.

BRIEF DESCRIPTION OF THE DRAWINGS

Other advantages and characteristics of the invention will be understood on reading the following description which refers to the accompanying drawings, showing preferred embodiments of the invention without any limiting character.

FIG. 10 is a longitudinal section view on X—X of FIG. 9 which is itself a plan view of one end of a heat exchanger.

FIG. 12 is a longitudinal section view on XII—XII of FIG. 11 which is itself a plan view of one end of a heat exchanger.

FIG. 13 is a fragmentary longitudinal section view of these pieces engaged at one end of a cylindrical cavity of a shell, while FIG. 14 is an outside view of the end of the shell receiving these pieces. FIG. 13 is a section view on XIII—XIII of FIG. 14.

MORE DETAILED DESCRIPTION

Unless specified to the contrary, elements, pieces, and members that are identical or similar and that are shown in two or more figures, are identified in those figures by respective references that remain unchanged from one figure to another.

Figure 1:
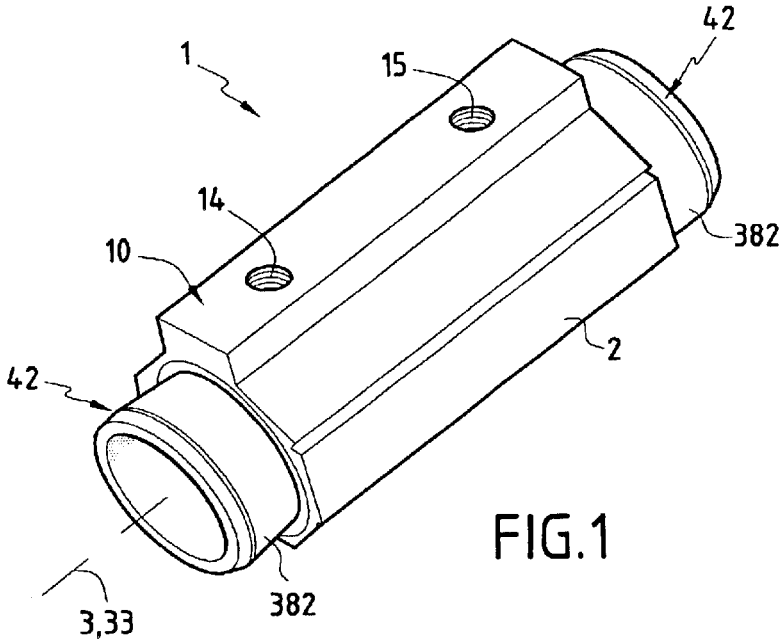
FIG. 1 is a perspective view of a preferred embodiment of a heat exchanger of the invention.

With reference to FIG. 1, the heat exchanger 1 comprises a shell 2 having a longitudinal axis 3, and a bundle of tubes received in the cavity defined inside the shell. The shell presents a plurality of plane outside faces 4 to 13 (see FIG. 3) that are elongate and parallel to the axis 3. Two channels 14 and 15 open out in the face 10 for coupling the cavity (defined by the shell) to two respective ducts (not shown) for transporting a fluid to be cooled (such as oil).

The shell is obtained as an aluminum extrusion. The resulting section member is quenched and cut into segments of the kind shown in FIGS. 2 and 3. As a result, both longitudinal ends of the shell are lacking in a flange for fixing the bundle to the shell. Each longitudinal end of the shell is machined so as to obtain a respective chamfer 16, 17 for facilitating insertion of the bundle of tubes carrying two sealing rings (referenced 19 and 20 in FIG. 8) into the cavity 18 that is defined by the shell, and without damaging the sealing rings.

The walls 10 to 12 define a longitudinal spline 23 extending parallel to the axis 3, with the channels 14 and 15 having radial axes 21 and 22 being pierced therein.

Figure 3:
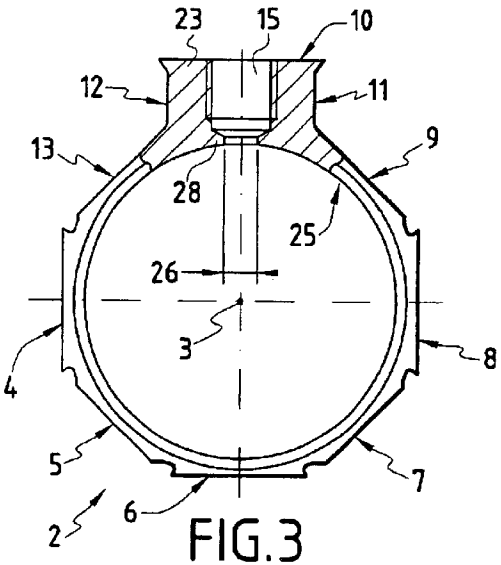
FIG. 3 is a cross-section view on III through the shell shown in FIG. 2.
Figure 2:
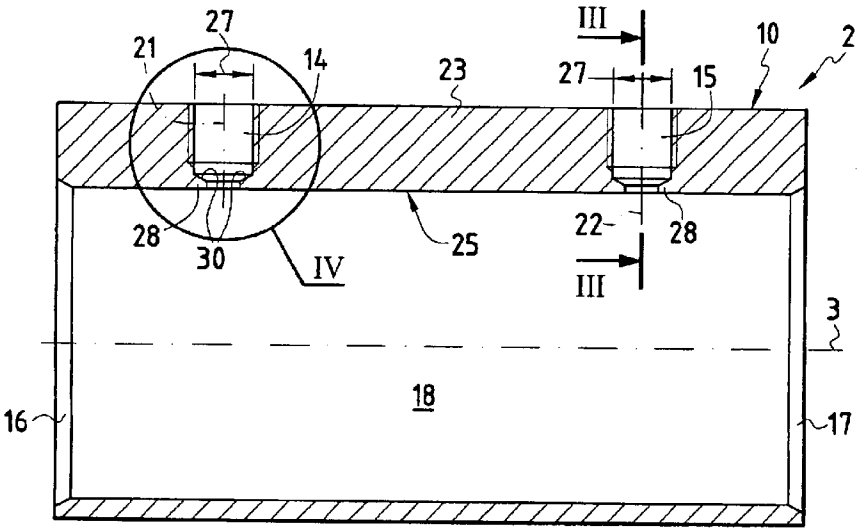
FIG. 2 is a longitudinal section through a shell of a heat exchanger of the invention.
Figure 4:
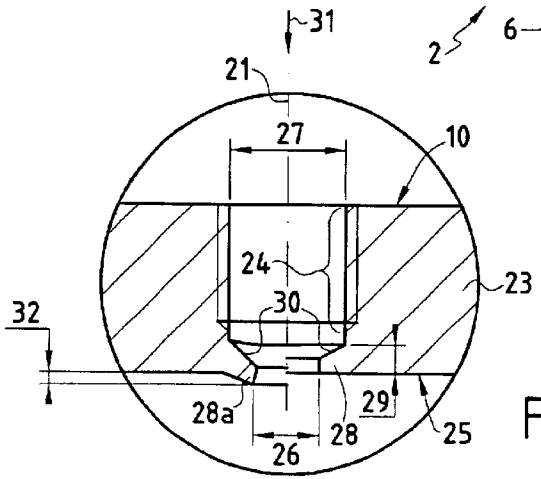
FIG. 4 is a detail view on a larger scale of portion IV showing one of the fluid passages pierced through the wall of the shell shown in FIG. 2.

With reference to FIGS. 2 to 4, each duct 14, 15 has an outer portion 24 that is tapped, extending from the face 10 and serving to enable a coupling (not shown) to be screwed therein. The inner portion of each duct opening out in the inside cylindrical face 25 of the cavity 18 is of a diameter 26 that is smaller than the diameter 27 of the orifice whereby the duct opens out in the face 10. This is because of the presence of an annular collar 28 formed in the wall 23 while piercing the ducts 14 and 15 by means of a drill bit that is shaped for this purpose. The thickness 29 of the collar 28 is small enough (e.g. about 1 millimeter (mm) to 2 mm) to allow it to be deformed under drive from a tool pressed against the sloping inside face 30 thereof in a direction shown by arrow 31 in FIG. 4. This makes it possible to cause at least a portion of the collar to move away from the initial configuration referenced 28 in FIG. 4 where the collar is flush with the face 25, to its final configuration referenced 28*a* in FIG. 4 where the deformed collar projects from the face 25 by an amount 32, e.g. close to one or two millimeters. In this deformed configuration, the collar is engaged in a setback provided in the periphery of the tube plate, as described below, thereby preventing the bundle from moving inside the shell.

This method of deforming the collar requires the shell to be made out of a material that presents breaking elongation that is sufficient. For this purpose, it is more favorable to use aluminum that has been extruded and quenched than to use aluminum that has been cast and/or injection molded.

In various embodiments, the hollow section member (or tube) used for making the shell can be obtained by extruding a plastics material, or by hot or cold drawing a metal, in particular an aluminum alloy, copper, or steel.

Figure 5:
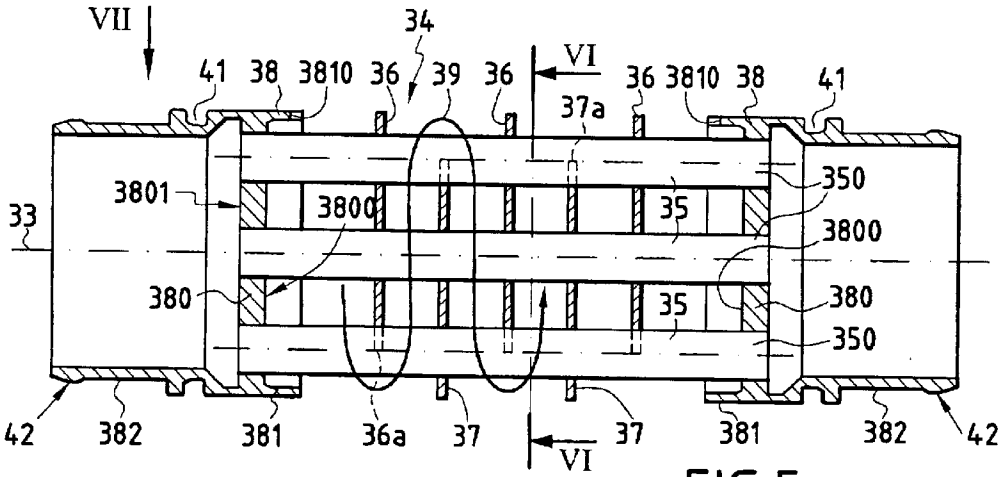
FIG. 5 is a longitudinal section view of a bundle of tubes for a heat exchanger of the invention.
Figure 7:
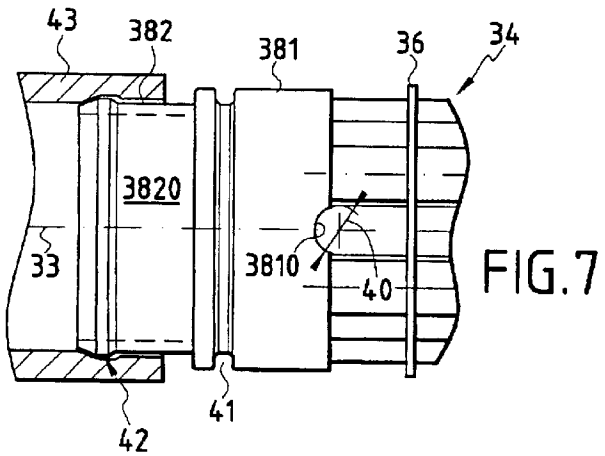
FIG. 7 is a side view of a piece forming a tube plate and a coupling sleeve, which piece includes a semicircular positioning notch in its internal periphery.
Figure 6:
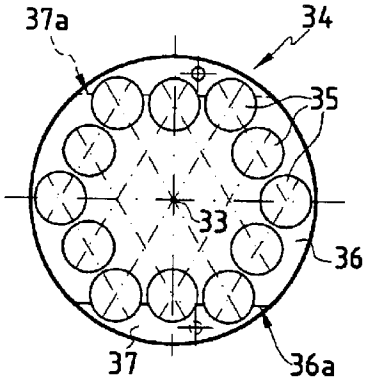
FIG. 6 is a diagrammatic cross-section on VI—VI through the bundle shown in FIG. 5.

With reference to FIGS. 5 to 7 in particular, the bundle 34 comprises a plurality of tubes 35 parallel to its longitudinal axis 33, a plurality of baffles 36 and 37 that are plane and perpendicular to the axis 33, and two end pieces 38.

The major portion of the outline of each baffle 36, 37 is circular (of diameter matching that of the cavity 18) together with a rectilinear portion 36*a*, 37*a* such that each baffle is in the form of a truncated disk. The baffles 36 whose rectilinear edges 36*a* are at their bottom ends are disposed along the axis 33 so as to alternate with the baffles 37 whose rectilinear edges 37*a* are at their top ends, so that the baffles co-operate with the shell to define a labyrinth causing the second fluid to follow a sinuous path 39 as shown in FIG. 5.

Each end piece 38 has a first portion 380 in the form of a thick disk having orifices pierced therein to receive the ends 350 of the tubes 35. This portion extending across the axis 33 forms the tube plate proper.

At the periphery of its internal face 3800, the first portion 380 is extended by a second portion 381 of the end piece 38, which second portion is in the form of a short segment of thin-walled tube about the axis 33. At one end of this segment, a notch 3810 is formed in the tubular wall, the outline of the notch being circular and of a diameter 40 that matches the dimensions (and in particular the diameter) of the projection 28*a* (see FIG. 4) formed on the inside face of the shell.

The first portion 380 of the end piece 38 is also extended at the periphery of its external face 3801 by a third portion 382 of the end piece 38 which third portion is generally in the form of a tubular segment about the axis 33, having an outside face that includes an annular groove 41 designed to receive one of the O-rings (19, 20, see FIG. 8) for providing sealing relative to the shell, together with an annular rib 42 projecting from the middle 3820 of this portion 382. As can be seen in FIG. 7, this third portion is suitable for receiving one end of a coupling tube 43 forced over the rib 42 and the cylindrical middle 3820 against which the tube 43 can be clamped by means of a clamping collar (not shown).

Figure 8:
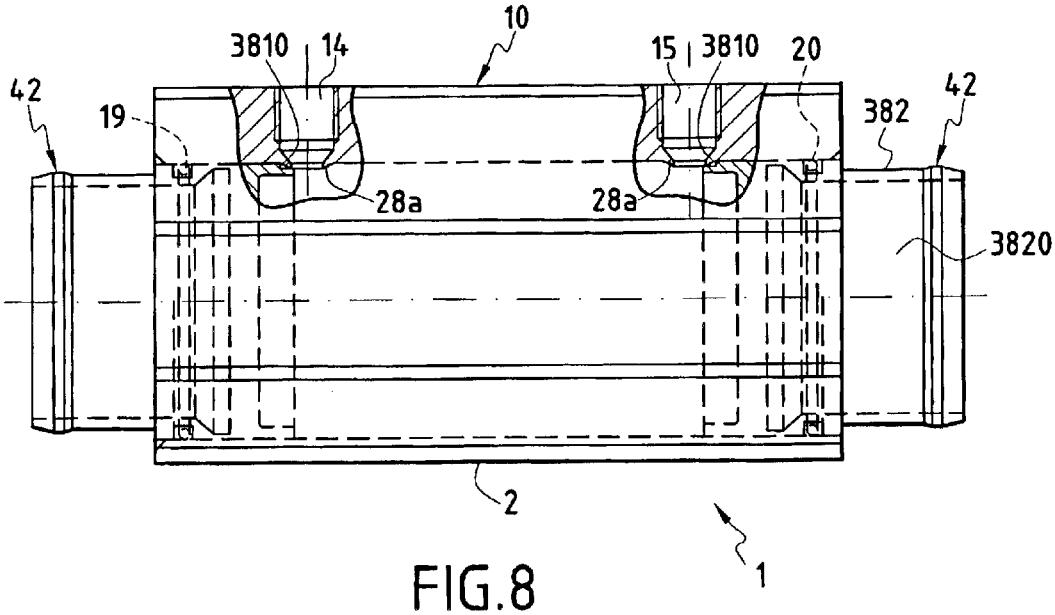
FIG. 8 is a side view showing diagrammatically how the bundle is assembled with the shell.

In the assembled configuration shown in FIG. 8, each of the notches provided in the end pieces faces a respective one of the inlet and outlet orifices 14, 15 and receives a corresponding portion of the annular projections extending said orifices such that the bundle is prevented from moving inside the shell. It is recalled that prior to engaging each projection into the corresponding notch, the bundle of tubes is free to slide inside the shell, as described in particular in the above-mentioned patents, since the tube plates are of outside diameter that is smaller than the inside diameter of the shell.

Figure 9:
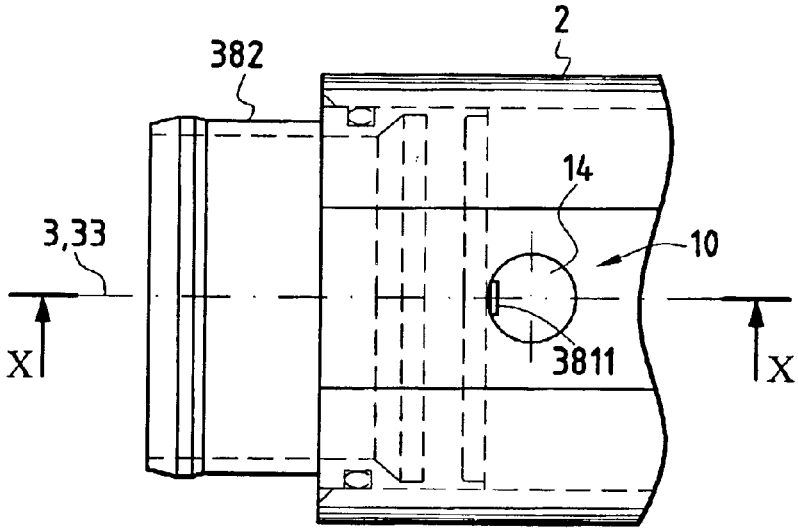
FIGS. 9 and 10 show a variant embodiment of the invention in which a tongue secured to a tube plate of the bundle is engaged in a fluid-passing orifice pierced through a spline of the shell.
Figure 10:
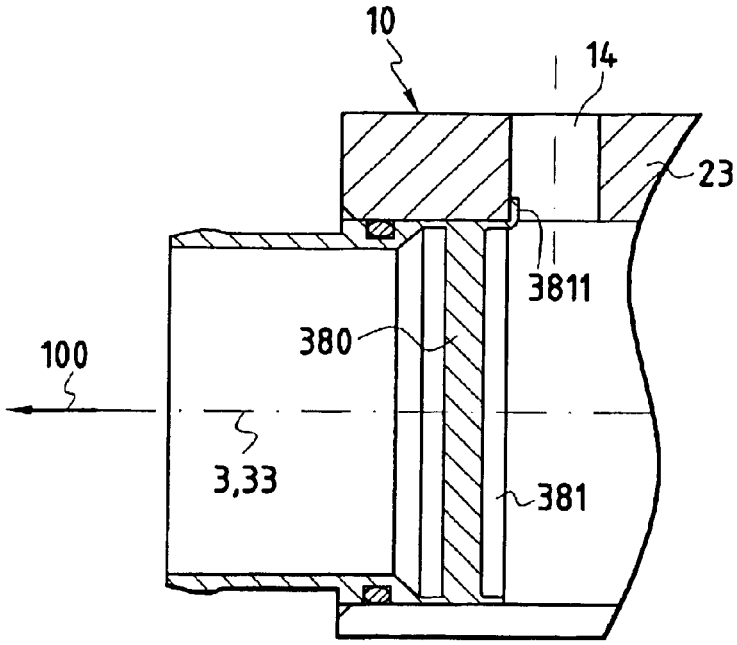

With reference to FIGS. 9 and 10, the tubular portion 381 about the axis 33 extending the tube plate 380 of the bundle itself has a portion 3811 in the form of a tongue which has been deformed after the bundle is positioned inside the shell so as to extend inside the fluid-passing orifice 14 and press against the wall defining said orifice. The tongue 3811 prevents the bundle from sliding inside the shell along their common axis 3, 33 in the direction identified by arrow 100. By fitting the other tube plate (not shown) of the same heat exchanger with a similar tongue, such sliding is also prevented in the opposite direction, and the bundle is also prevented from turning.

Figure 11:
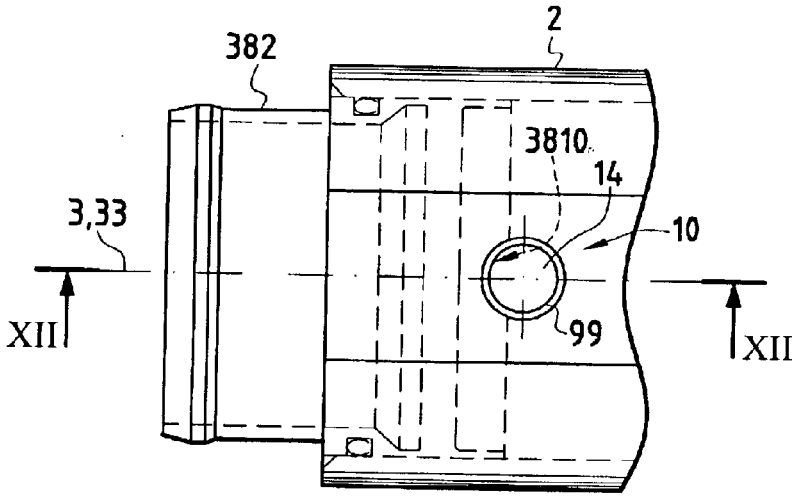
FIGS. 11 and 12 show a variant embodiment of the invention in which a tubular coupling sleeve serving as an abutment for preventing the bundle from moving is engaged in a fluid-passing orifice pierced through a spline of the shell.
Figure 12:
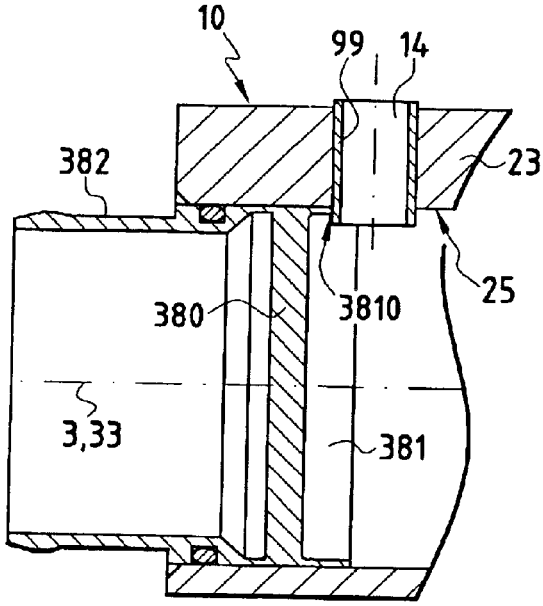

With reference to FIGS. 11 and 12, a tubular sleeve 99 extends inside the fluid-passing duct 14 pierced through the spline 23 of the shell, the sleeve extending along the axis 21 of the duct, with the sleeve bearing against the walls thereof.

The sleeve 99 projects from the inside face 25 of the shell. As a result it is engaged in a notch 3810 identical or similar to that described above, thereby restricting sliding of the bundle inside the shell. By fitting a second duct (as referenced 15) with a second sleeve also projecting into the shell, the bundle is prevented from sliding or turning inside the shell.

Figure 13:
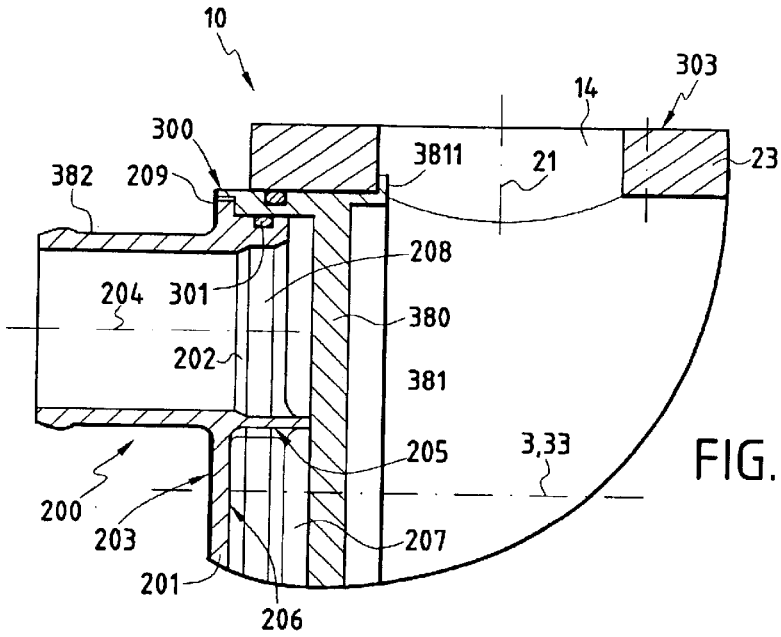
FIGS. 13 and 14 show another variant embodiment of the invention in which a cap for coupling the heat exchanger to a fluid transport circuit is made separately from a tube plate of the bundle of tubes, and is partially engaged in said plate to which it can be secured by crimping.
Figure 14:
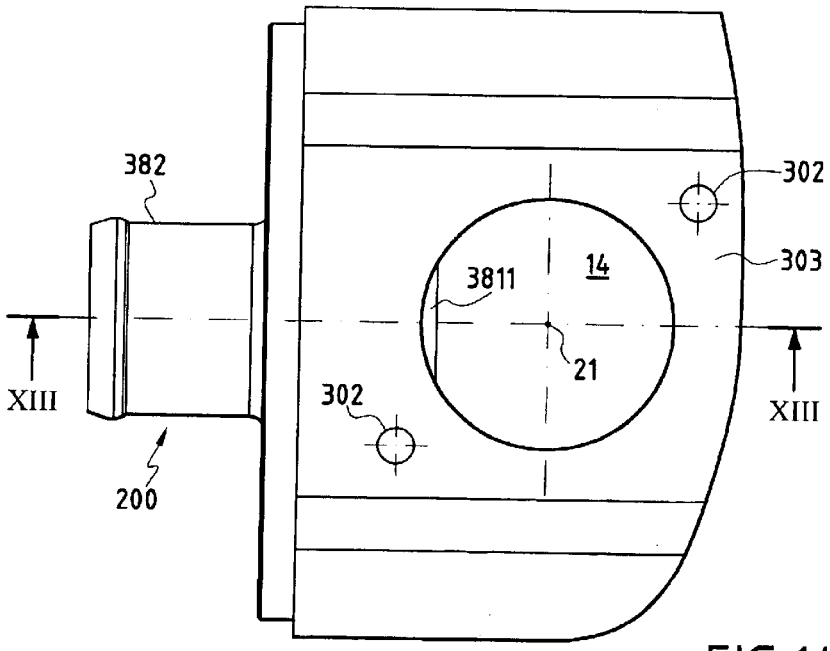

In the embodiment shown in FIGS. 13 and 14, the bundle and the shell are mutually engaged as described with reference to FIGS. 9 and 10 by a tongue 3811 penetrating into the orifice 14 pierced through the wall 23 of the shell. However, unlike the embodiments described above, the cylindrical sleeve 382 for coupling the heat exchanger to a tube (such as 43, FIG. 7) is not integrated in the end piece 38, but forms a separate piece 200. The piece 200 acts as an end tank, and for this purpose it comprises a wall 201 in the form of a disk pierced by an orifice 202 surrounded by the cylindrical wall of the sleeve 382 which extends from the outside face 203 of the wall 201 along an axis 204 parallel to the axes 3 and 33, and remote from said axes.

The piece 200 also has a wall 205 extending from the inside face 206 of the wall 201, perpendicularly thereto and to the tube plate 380 so as to make contact with the tube plate. The wall 205 serves as a partition serving to subdivide the end tank in leakproof manner into two adjacent compartments 207 and 208.

This configuration allows fluid to flow inside the sleeve 382 and along tubes in the bundle in a plurality of passes along tubes of the bundle.

In this configuration, the wall 201 can be crimped at its circular periphery 209 in a bore provided at the outside end 300 of the end piece 38. An additional seal 301 is generally required to provide sealing between the parts 38 and 200. As shown in FIGS. 13 and 14, two orifices 302 are pierced in the wall 23 around the duct 14 and they are diametrically opposite about the axis 21. The orifices 302 open out in the plane longitudinal outside face 303 of the spline 23 and enable a flange fitted to a tube (not shown) transporting the second fluid to be fixed to the shell.

What is claimed is:

1. A heat exchanger comprising a multi-tube bundle and a shell, in which mutual engagement between the shell and the bundle forms an abutment inside a cavity defined by the shell, which abutment prevents or restricts movement of the bundle relative to the shell, in which the shell presents an inlet orifice for admitting fluid into the cavity and an outlet orifice for exhausting fluid from the cavity, and in which a projection placed around at least one of said orifices forms at least a portion of said abutment.

2. A heat exchanger according to claim 1, in which the mutual engagement results at least in part from the bundle being enlarged.

3. A heat exchanger according to claim 1, in which the mutual engagement results at least in part from the cavity being narrowed.

4. A heat exchanger according to claim 1, in which the shell is constituted essentially by at least a segment of hollow section member defining a cylindrical cavity.

5. A heat exchanger according to claim 4, in which the section member is made of metal which has been drawn or extruded.

6. A heat exchanger according to claim 1, in which the shell presents at least one outside longitudinal spline through which the orifices are pierced.

7. A heat exchanger according to claim 1, in which at least a portion of said projection forms an integral portion of the shell.

8. A heat exchanger according to claim 1, in which at least a portion of the projection is secured to a coupling member co-operating with one of the orifices.

9. A heat exchanger according to claim 1, in which the bundle includes baffles in the form of truncated disks and/or in the form of disk portions, and in which a narrowing of the cavity or an enlargement of the bundle forms an abutment preventing or restricting movement in rotation and/or translation of the bundle in the cavity.

10. A heat exchanger according to claim 1, in which the bundle has an end tube plate and a cap for coupling the heat exchanger to a duct for transporting fluid that flows in the tubes of the bundle, and in which the tube plate and the cap form a single piece.

11. A heat exchanger according to claim 10, in which the cap presents an annular rib situated on an external tubular and/or cylindrical portion of the cap so as to enable a duct to be secured to the cap by forced engagement and/or by clamping.

12. A heat exchanger according to claim 1, in which the abutment co-operates with a part secured to the tube plate of the bundle to prevent or restrict sliding and/or turning of the bundle of tubes inside the cavity.

13. A heat exchanger according to claim 12, in which the tube plate presents a setback or notch co-operating with an abutment projecting from the inside face of the wall of the shell.

14. A heat exchanger according to claim 13, in which the bundle has two tube plates, each having an annular groove in its outside face receiving a seal bearing against a cylindrical bearing surface of the shell.

15. A heat exchanger for exchanging heat between a first fluid and a second fluid, the heat exchanger comprising:

a multi-tube bundle comprising:

a plurality of tubes for transporting the first fluid;

a plurality of baffles for guiding the second fluid flowing around the tube; and at least one tube plate pierced by orifices and secured to the tubes;

a shell comprising a segment of hollow section member defining a cylindrical cavity receiving the bundle, the shell having a wall pierced by a first duct for admitting second fluid into the cavity and by a second duct for exhausting the second fluid from the cavity;

in which the tube plate has a groove receiving a seal bearing against an inside face of the cylindrical cavity;

the heat exchanger further including an abutment preventing or restricting movement of the bundle inside the cavity of the shell, the abutment projecting inside at least one of said first and second ducts.

16. A heat exchanger according to claim 15, in which the cross-section of the cavity is circular, and in which the cross-section of the outside face of the wall of the shell presents a rectilinear portion corresponding to a plane portion of said outside face, the plane portion extending substantially along the entire length of the shell, and said first and second ducts opening out into said plane portion.

* * * * *